US010604921B2

(12) United States Patent
Kashirajima et al.

(10) Patent No.: US 10,604,921 B2
(45) Date of Patent: Mar. 31, 2020

(54) FLUSH TOILET

(71) Applicant: TOTO LTD., Kitakyushu-shi, Fukuoka (JP)

(72) Inventors: Shu Kashirajima, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 25 days.

(21) Appl. No.: 15/626,537

(22) Filed: Jun. 19, 2017

(65) Prior Publication Data

US 2017/0370080 A1 Dec. 28, 2017

(30) Foreign Application Priority Data

Jun. 27, 2016 (JP) ..... 2016-126606

(51) Int. Cl.
*E03D 1/08* (2006.01)
*E03D 11/08* (2006.01)

(52) U.S. Cl.
CPC ..... *E03D 1/087* (2013.01); *E03D 11/08* (2013.01); *E03D 2201/30* (2013.01)

(58) Field of Classification Search
CPC ..... E03D 1/263; E03D 11/02; E03D 11/06; E03D 11/08; E03D 11/18; E03D 1/087
USPC ..... 4/425
See application file for complete search history.

(56) References Cited

U.S. PATENT DOCUMENTS 1,973,349 A * 9/1934 Kruse ..... E03D 11/06 4/425
1,979,739 A * 11/1934 Groeniger ..... E03D 11/06 4/425
2,129,398 A * 9/1938 Beam ..... E03D 11/06 4/425
2,212,518 A * 8/1940 Groeniger ..... E03D 11/08 4/252.1
2006/0005310 A1 1/2006 Nakamura et al.

FOREIGN PATENT DOCUMENTS

JP 4529178 B2 8/2010
JP 5429688 B2 2/2014
JP 2015-168994 A 9/2015
TW I247838 B 1/2006

OTHER PUBLICATIONS

An Office Action issued by State Intellectual Property Office dated Apr. 13, 2018, which corresponds to Taiwanese Patent Application No. 106119297 and is related to U.S. Appl. No. 15/626,537; with brief English translation.

* cited by examiner

*Primary Examiner* — Tuan N Nguyen
(74) *Attorney, Agent, or Firm* — Studebaker & Brackett PC

(57) ABSTRACT

A flush toilet is provided, which can advance timing for startup of a siphon action that discharges waste, and can efficiently discharge waste from a water discharge trap conduit. A flush toilet of the present invention has a bowl section, a water discharge trap conduit connected to a lower portion of the bowl section, and a jet spout port that is opened toward the water discharge trap conduit, in the lower portion of the bowl section, and the jet spout port includes an outlet flow path in which a bottom surface extending toward an outlet of the jet spout port and toward a bowl section bottom surface in the lower portion of the bowl section, and a ceiling surface extending toward the outlet and having an inclination toward an upper direction than an inclination of the bottom surface are formed.

5 Claims, 8 Drawing Sheets

FLUSH TOILET

TECHNICAL FIELD

The present invention relates to a flush toilet, and particularly relates to a flush toilet that is washed by flushing water supplied from a flushing water source to discharge waste.

BACKGROUND ART

Conventionally, there has been known a siphon jet toilet in which a jet spout port 132 extending rectilinearly toward a center of an inlet portion 122*a* of a water discharge trap conduit 122 is disposed in order to perform startup of a siphon and discharge of waste efficiently by a jet spout water flow from the jet spout port in the siphon jet toilet, as shown in Patent Document 1 (Japanese Patent No. 5429688) and Patent Document 2 (Japanese Patent No. 4529178).

SUMMARY OF THE INVENTION

Technical Problem

However, when the water force of a jet spout water flow heading toward the center of the inlet portion 122*a* of the water discharge trap conduit 122 from the jet spout port 132 is increased in order to actuate a stronger siphon, the above described structure has had the problem that the jet spout water flow collides with the trap rising pipe of the water discharge trap conduit 122, a loss occurs to the flow and a stronger siphon cannot be actuated. As illustrated in FIG. 7, the conventional siphon jet flush toilet includes the jet spout port 132 that rectilinearly extends toward the center of the inlet portion 122*a* of the conventional water discharge trap conduit 122, and an analysis result in FIG. 7 shows a state in which the jet spout water flow from the jet spout port 132 collides with a region E on a bottom surface of the opposing water discharge trap conduit 122 in front. In the numerical analysis result, directions of flows of flushing water are shown by arrows. Further, long arrows in dark colors (dark gray and color close to black) in terms of density show regions where a flow velocity of flushing water is high and a water force is strong, and short arrows in light colors (light gray and color substantially close to white) in terms of density show regions where a flow velocity of flushing water is low and a water force is weak.

Thus, in order to generate a siphon action early and enhance the ability to discharge waste, there is known a siphon jet flush toilet as described in Patent Document 3 (Japanese Published Unexamined Patent Application No. 2015-168994). As illustrated in FIG. 8, in the conventional siphon jet flush toilet, a jet spout port 232 is formed to be parallel with a bottom surface 220*a* of a bowl section 220 in order to feed a jet spout water flow without loss from the jet spout port 232 to a water discharge trap conduit 222. It has been considered to reduce loss of a flow of flushing water and advance timing for startup of the siphon action, by injecting the jet spout water flow along the bottom surface 220*a* of the bowl section 220 by the jet spout port 232 like this.

However, as illustrated in FIG. 8, while the force of flushing water in a lower side region B of an inlet portion 222*a* of the water discharge trap conduit 222 is strong and the flow velocity is made high, the force of the jet spout water flow at an upper side region A is weak, so that there arises the problem of being unable to discharge waste favorably to cause the waste to remain, and the like.

Consequently, the present invention is made to solve the problems of the conventional arts described above, and has an object to provide a flush toilet that can advance timing for startup of a siphon action that discharges waste, and can efficiently discharge waste from a water discharge trap conduit.

Solution to Problem

In order to attain the aforementioned object, the present invention is a siphon type flush toilet that is washed by flushing water supplied from a flushing water source, having a bowl section including a bowl-shaped waste receiving surface, and a rim section formed on an upper edge of the waste receiving surface, a water discharge trap conduit that is connected to a lower portion of the bowl section to discharge waste, and a jet spout port that is opened toward an inlet of the water discharge trap conduit, wherein the jet spout port includes an outlet flow path having an outlet bottom surface extending diagonally downward to an outlet of the jet spout port, and a ceiling surface extending toward the outlet and having more inclination extending toward an upper direction than an inclination of the outlet bottom surface are formed.

In the present invention configured in this way, the outlet flow path of the jet spout port forms the outlet bottom surface that extends toward the outlet of the jet spout port and toward the bowl section bottom surface in the lower portion of the bowl section. Accordingly, timing for startup of a siphon action that discharges waste can be advanced, by forming a water flow along the bottom surface of the water discharge trap conduit from the bottom surface of the lower portion of the bowl section by the jet spout water flow at the initial stage of water supply, and filling the water discharge trap conduit relatively early. Further, the outlet flow path of the jet spout port forms the ceiling surface extending toward the outlet and having more inclination extending toward an upper direction than the inclination of the outlet bottom surface. Accordingly, a flow that pushes waste to the downstream side can be also formed in the upper side region of the water discharge trap conduit by the flow of a part of jet water flow flowing along the ceiling surface by a Coanda effect, and waste can be efficiently discharged from the water discharge trap conduit. Consequently, according to the present invention, in the siphon type flush toilet, discharge performance of waste from the inside of the water discharge trap conduit can be enhanced.

In the present invention, it is preferable that the outlet bottom surface of the outlet flow path of the jet spout port is connected to the bowl section bottom surface in the lower portion of the bowl section to be substantially flush with the bowl section bottom surface.

In the present invention configured in this way, the jet spout water flow at an initial stage of water supply can be formed as a smooth water flow along the bowl section bottom surface in the lower portion of the bowl section from the outlet bottom surface of the outlet flow path of the jet spout port. Consequently, according to the present invention, the water flow along the bottom surface of the water discharge trap conduit from the bowl section bottom surface is formed earlier, and the water discharge trap conduit is filled relatively early, whereby the timing for startup of the siphon action that discharges waste can be more advanced.

In the present invention, it is preferable that the ceiling surface of the outlet flow path of the jet spout port extends substantially horizontally.

In the present invention configured in this way, the ceiling surface of the outlet flow path of the jet spout port extends toward the outlet substantially horizontally. Consequently, according to the present invention, the flow that pushes waste in the horizontal direction toward the downstream side can be formed in the upper side region of the water discharge trap conduit by the flow of a part of the jet spout water flow that flows along the ceiling surface by the Coanda effect, and waste can be discharged from the water discharge trap conduit more efficiently.

In the present invention, it is preferable that the jet spout port further includes a narrow portion that narrows a flow path in a further upstream side than the outlet flow path of the jet spout port.

In the present invention configured in this way, the jet spout port includes the narrow portion that narrows a flow path sectional area of the flow path in a further upstream side than the outlet flow path of the jet spout port, and therefore, can increase a flow velocity of the flow of the jet spout water spouted from the jet spout port. Consequently, the flow velocity of the flow of the jet spout water spouted from the jet spout port at the initial stage of water supply is increased, the water discharge trap conduit is filled relatively early, and the timing for startup of the siphon action that discharges waste can be more advanced. Further, the flow velocity of the flow of a part of the jet spout water flow that flows along the ceiling surface by the Coanda effect is increased, so that a stronger flow that pushes waste to the downstream side can be formed in the upper side region of the water discharge trap conduit, and waste can be efficiently discharged from the water discharge trap conduit. Consequently, according to the present invention, the discharge performance of waste from the inside of the water discharge trap conduit can be more enhanced.

In the present invention, it is preferable that the ceiling surface of the outlet flow path of the jet spout port is formed to be oriented toward an upper side region between a top portion of an inlet portion of the water discharge trap conduit and a center portion of the inlet portion of the water discharge trap conduit.

In the present invention configured in this way, the ceiling surface is formed to be oriented toward the upper side region between the top portion of the inlet portion of the water discharge trap conduit and the center of the inlet portion of the water discharge trap conduit. Consequently, according to the present invention, the flow that pushes waste to the downstream side can be formed in the upper side region of the water discharge trap conduit, by the flow of a part of the jet spout water flow that flows along the ceiling surface by the Coanda effect, and waste can be efficiently discharged from the water discharge trap conduit.

Advantageous Effects of the Invention

According to the siphon type flush toilet of the present invention, the timing for startup of the siphon action that discharges waste can be advanced, and the waste can be efficiently discharged from the water discharge trap conduit, by filling the water discharge trap conduit relatively early.

DESCRIPTION OF EMBODIMENTS

Hereunder, a flush toilet according to one embodiment of the present invention will be described with reference to the drawings.

First, based in FIGS. 1 to 3, a basic structure of the flush toilet according to the one embodiment of the present invention will be described.

Figure 1:
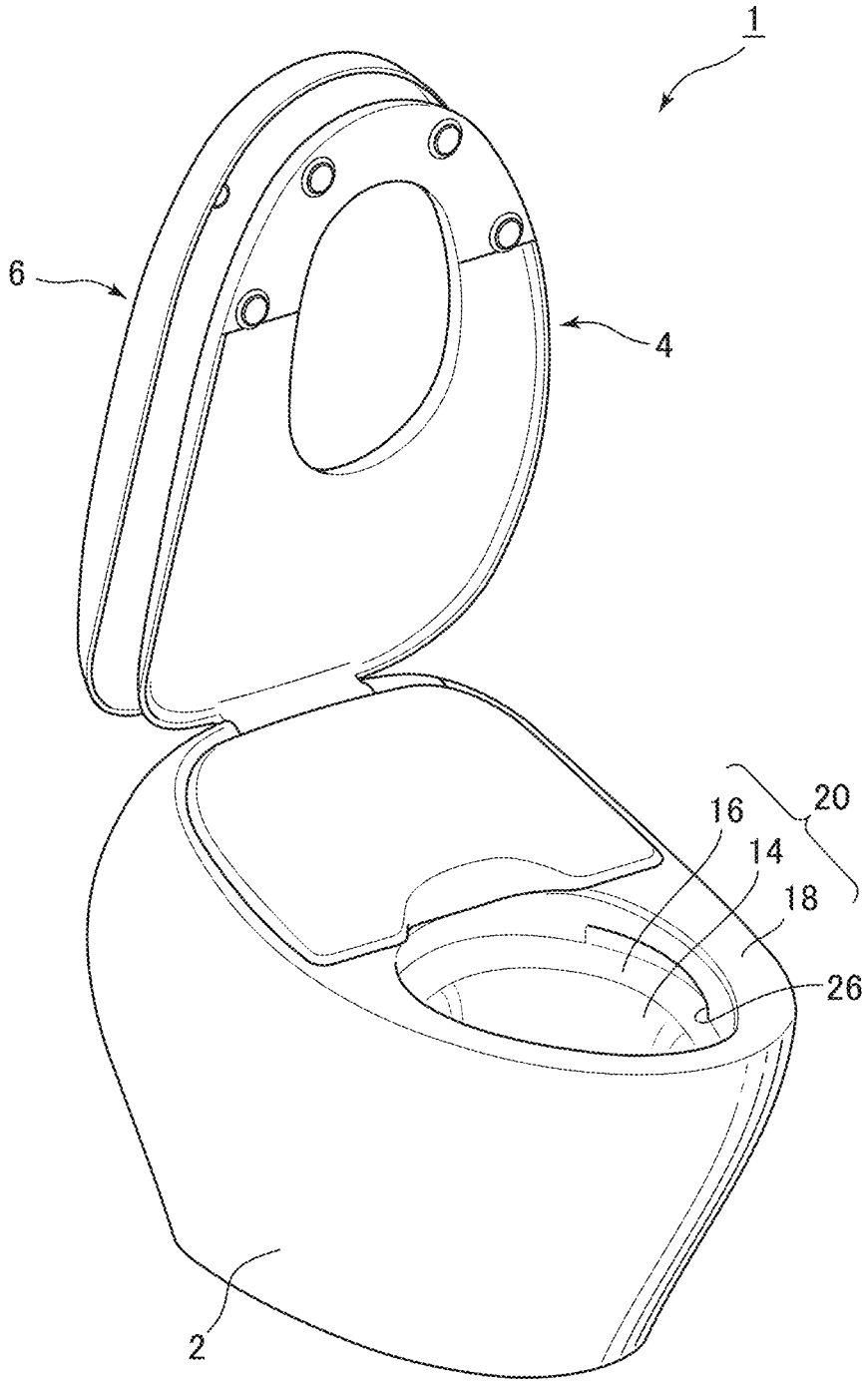
FIG. 1 is a perspective view illustrating a flush toilet according to one embodiment of the present invention, and illustrates a state in which a toilet lid and a toilet seat are turned to an upper position.
Figure 2:
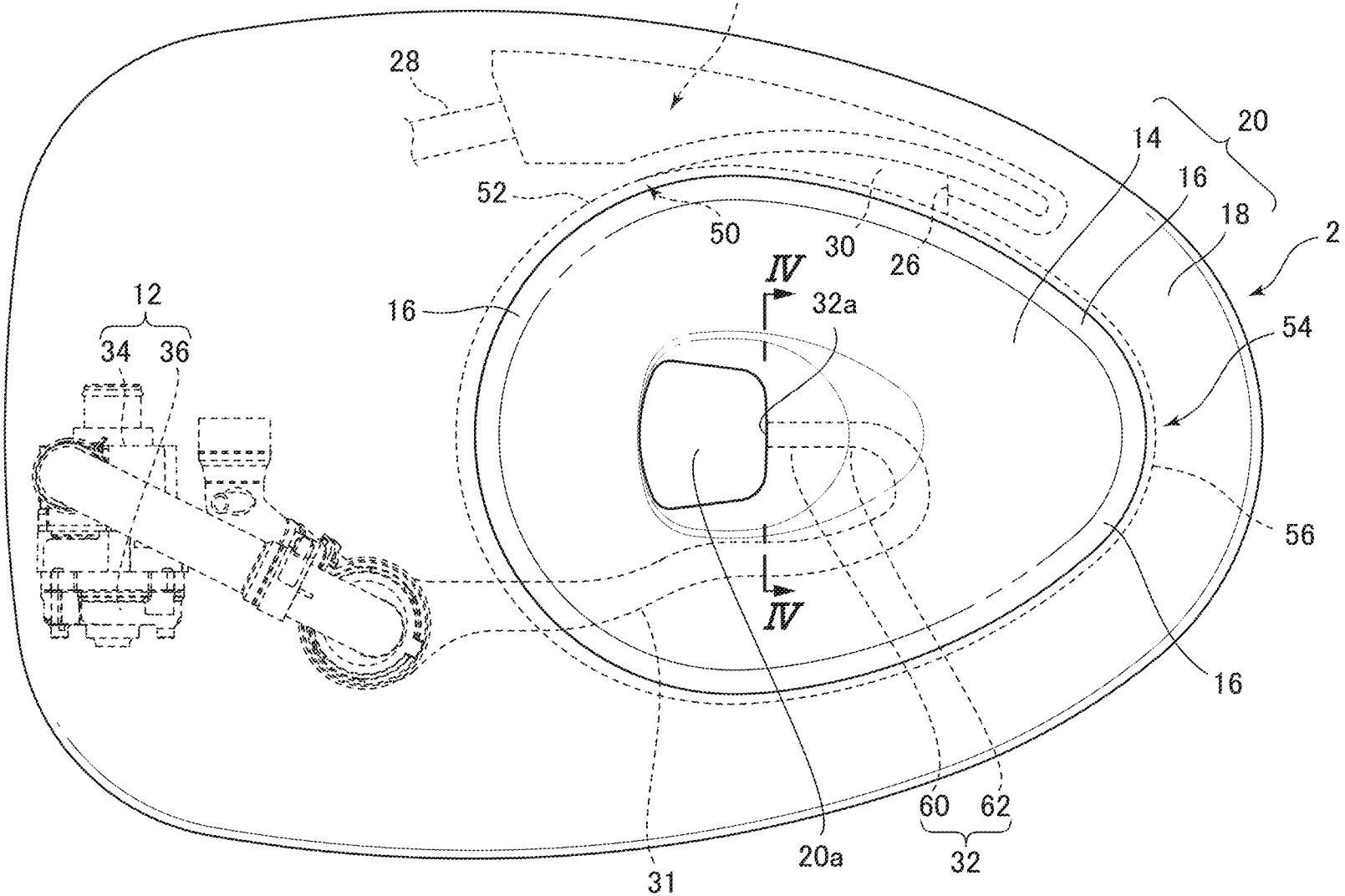
FIG. 2 is a partial plane view illustrating a toilet main body section of the flush toilet according to the one embodiment of the present invention illustrated in FIG. 1.
Figure 3:
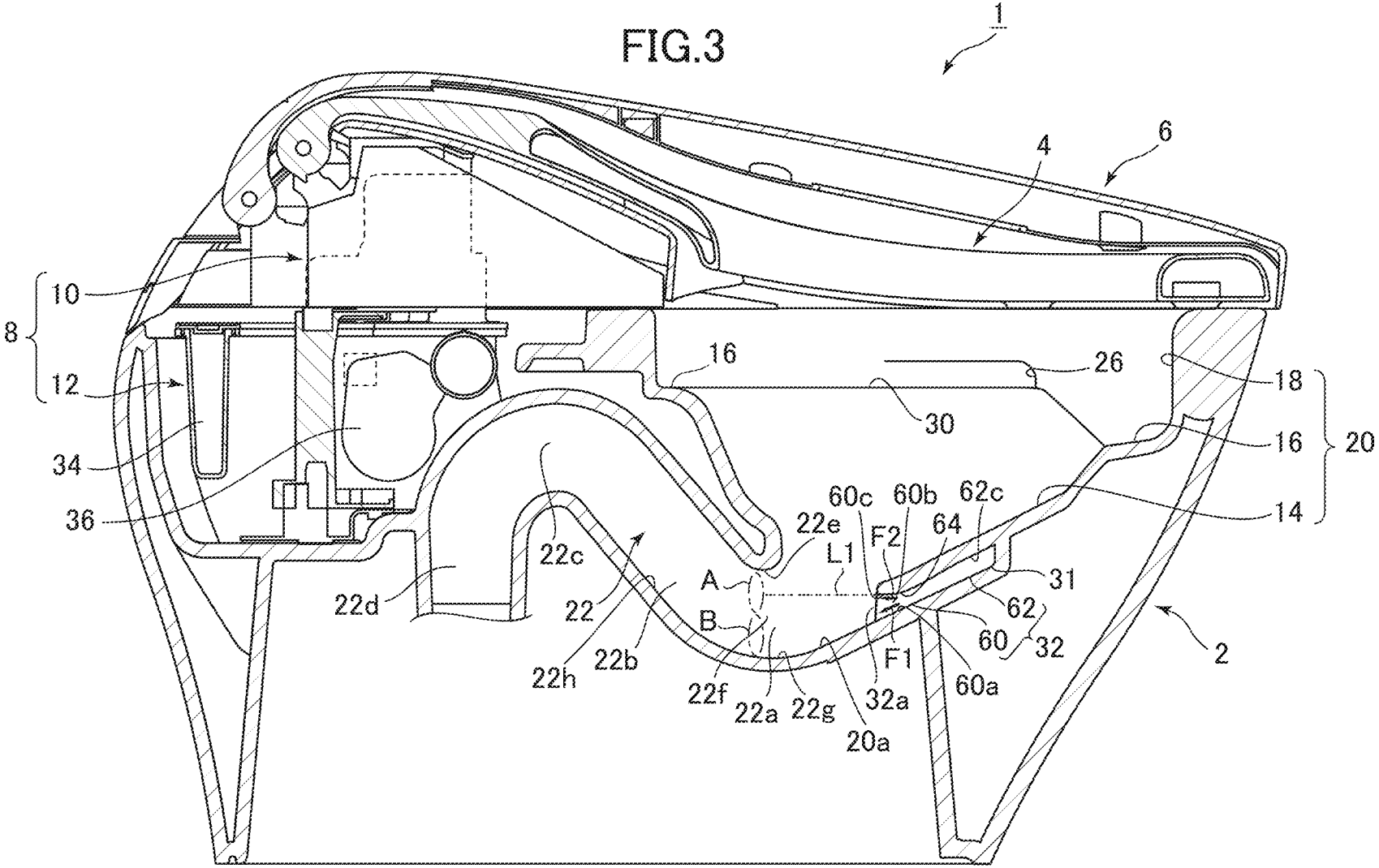
FIG. 3 is a sectional view of a section along a center in a lateral direction in the flush toilet according to the one embodiment of the present invention, seen from a left side, and illustrates a state in which the toilet lid and the toilet seat are turned to a lower position.

As illustrated in FIGS. 1 to 3, a flush toilet 1 according to the one embodiment of the present invention includes a toilet main body 2 made of ceramic, a toilet seat 4 disposed on a top surface of the toilet main body 2 to be capable of turning in a vertical direction, a toilet lid 6 disposed rotatably in the vertical direction to cover the toilet seat 4, and a function section 8 disposed at a rear side of the toilet main body 2.

As illustrated in FIG. 3, the function section 8 includes a sanitary cleaning system function section 10 functioning as a sanitary cleaning section that cleans private parts of a user, and a water supply system function section 12 relating to a function of water supply to the toilet main body 2.

Next, as illustrated in FIGS. 1 to 3, the toilet main body 2 includes a bowl section 20, and the bowl section 20 includes a bowl-shaped waste receiving surface 14, and a rim portion 18 formed to be raised from a ledge surface 16 on an upper edge of the waste receiving surface 14.

Here, as illustrated in FIG. 3, the toilet main body 2 includes a water discharge trap conduit 22 that is a drain path for discharging waste in the bowl section 20, and an inlet portion 22*a* of the water discharge trap conduit 22 is connected to a lower side of the bowl section 20. The flush toilet 1 according to the one embodiment of the present invention is a so-called siphon type flush toilet that sucks waste in the bowl section 20 by using a siphon action to discharge the waste to an outside from the water discharge trap conduit 22 at once.

As illustrated in FIG. 2, in the bowl section 20, a rim water path 24 is formed inside the rim portion 18 in a right side of a front part of the toilet main body 2.

An upstream side of the rim water path 24 is connected to a water conduit 28 that conducts flushing water, and an upstream side of the water conduit 28 is directly connected to city water utility (not illustrated) that is a flushing water source. By using pressure of water supply of city water utility, flushing water that is supplied into the rim water path 24 from the water conduit 28 is led forward in the rim water path 24, and thereafter, bends inward and to a rear side to be led to a rim spout port 26 formed in a downstream end of the rim water path 24.

The rim spout port 26 in the rim water path 24 may be disposed in a position in a left side of the front part, a position in a right side of a rear part, or a position in a left side of the rear part, of the toilet main body 2.

As illustrated in FIG. 2, a jet spout port 32 (a jet spout port section) is formed at a lower portion of the bowl section 20, and the jet spout port 32 is opened to be directed to the inlet portion 22*a* of the water discharge trap conduit 22. The jet spout port 32 forms a flow path extending directly to a rear part from a front part of the toilet main body 2, in plane view.

Here, the aforementioned water supply system function section 12 includes a water storage tank 34, and flushing water stored in the water storage tank 34 is pressurized by a pressure pump 36 to be supplied to the jet spout port 32. Therefore, the jet spout port 32 is formed in a downstream end portion of the jet water conduit 31 extending from the water storage tank 34.

When a water supply using water utility direct pressure supply is adopted as a supply water source for supplying flushing water to the jet water conduit 31, the pressure pump 36 may be omitted, because water pressurized by supply water pressure of city water utility is supplied.

As illustrated in FIG. 2, the jet water conduit 31 extends while descending forward from a rear part at a left side of the toilet main body 2 in top view, and forms a flow path that is along an outer side of a back surface of the waste receiving surface 14. The jet water conduit 31 extends toward a front side at a side part of a water storage portion, and thereafter extends toward a center of the toilet main body 2. Further, the jet water conduit 31 changes a direction to a rear in a front side of the water storage portion to extend toward the water storage portion. In the jet water conduit 31, a flow path shape like this is made of ceramic.

Here, detailed explanation of respective specific structures of the sanitary cleaning system function section 10 and the water supply system function section 12 will be omitted since the specific structures thereof are similar to the conventional ones. The water supply system function section 12 is provided with a controller or the like that controls an on/off operation of an electromagnetic valve, a switching operation of a changeover valve, and a number of revolutions, an operating time period and the like of the pressure pump.

The flush toilet 1 according to the present embodiment is a hybrid type flush toilet, which performs rim water spout by the rim spout port 26 by using water supply pressure of city water, and supplies flushing water in the water storage tank 34 by controlling the pressure pump 36 for jet water spout by the jet spout port 32. The flush toilet may switch the flushing water from city water to rim water spout by the rim spout port 26 and jet water spout by the jet spout port 32 by switching a valve. Further, the flush toilet may switch the flushing water which is supplied from the water storage tank to rim water spout by the rim spout port 26 and jet water spout by the jet spout port 32.

Next, with reference to FIGS. 2 to 4, a detailed structure of the jet spout port 32 of the jet water conduit 31 will be described.

Figure 4:
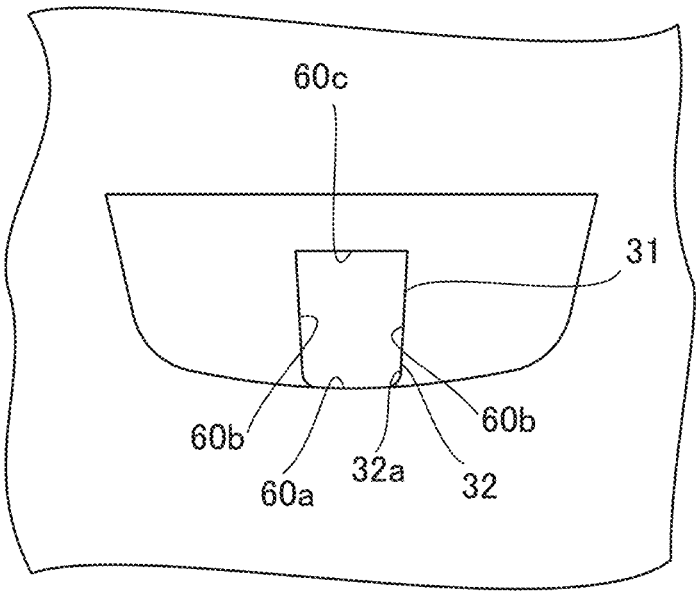
FIG. 4 is a partial enlarged view of a jet spout port in a jet water conduit in the flush toilet according to the one embodiment of the present invention illustrated in FIG. 1, seen from a water discharge trap conduit side.

First, as illustrated in FIGS. 2 to 4, the jet spout port 32 includes an outlet flow path 60 extending to an outlet 32*a* of the jet spout port 32, and a connection portion 62 that is connected to an upstream side end portion (inlet) of the outlet flow path 60.

The outlet flow path 60 of the jet spout port 32 includes a bottom surface 60*a* extending diagonally downward to the outlet 32*a* of the jet spout port 32, side walls 60*b* raised upward from both sides of the bottom surface 60*a*, and a ceiling surface 60*c* extending toward the outlet 32*a*.

The outlet 32*a* of the outlet flow path 60 of the jet spout port 32 is located slightly upward from a lowermost end of a bottom surface 20*a* of the bowl section 20. The bottom surface 20*a* of the bowl section 20 in a vicinity of the outlet 32*a* of the outlet flow path 60 forms a downward inclination toward an inlet portion 22*a* side of the water discharge trap conduit 22. The bowl section bottom surface 20*a* is connected to a bottom surface 22*h* of a rising conduit of the water discharge trap conduit 22.

As illustrated in FIG. 4, the outlet flow path 60 of the jet spout port 32 forms a flow path extending in a longitudinal direction. The outlet flow path 60 is a flow path having a substantially quadrangular section along the lateral direction. The bottom surface 60*a* and/or the ceiling surface 60*c* of the outlet flow path 60 may form a bent shape, for example, a tube shape, in a section in the lateral direction.

The bottom surface 60*a* of the outlet flow path 60 is substantially flat. The bottom surface 60*a* of the outlet flow path 60 may be disposed at a comparatively low position, and may be formed to extend substantially horizontally toward the bottom surface 20*a* of the bowl section 20. At this time, the ceiling surface 60*c* of the outlet flow path 60 can have an inclination that extends upward than an inclination (substantially horizontal inclination) of the bottom surface 60*a*.

The bottom surface 60*a* of the outlet flow path 60 and the bottom surface 20*a* of the bowl section 20 are connected to be substantially flush with each other. A downward inclination of the bottom surface 60*a* of the outlet flow path 60 has substantially the same angle of a downward inclination as a downward inclination of the bottom surface 20*a* of the bowl section 20. Therefore, the flushing water can flow down smoothly on the same plane along the bottom surface 20*a* of the bowl section 20 from the bottom surface 60*a* of the outlet flow path 60. Being substantially flush with each other includes a state of approximately flush with each other, and a state in which the bottom surface 60*a* and the bottom surface 20*a* are connected as approximately a plane although a displacement of a degree of about a production error exists between the bottom surface 60*a* of the outlet flow path 60 and the bottom surface 20*a* of the bowl section 20.

As illustrated in FIG. 4, the side wall 60*b* of the outlet flow path 60 forms a substantially flat plane. Each of the side walls 60*b* is formed so that an upper portion of the side walls slightly opens more outward in the lateral direction than a lower portion of them, in sectional view in the lateral direction of the outlet flow path 60.

The ceiling surface 60*c* of the outlet flow path 60 forms a substantially flat plane. The ceiling surface 60*c* of the outlet flow path 60 forms a plane extending substantially horizontally in the longitudinal direction of the toilet main body 2. The ceiling surface 60*c* has an inclination heading toward an upper direction than the downward inclination of the outlet flow path bottom surface 60*a*. The ceiling surface 60*c* of the outlet flow path 60 may form a downward inclination with a smaller inclination angle than the downward inclination of the bottom surface 60*a*, or an upward inclination heading upward to the outlet 32*a*.

The ceiling surface 60*c* of the outlet flow path 60 has an inclination heading upward from a downward inclination of a ceiling surface 62*c* of the connection portion 62. A corner portion 64 forming a gradual curve is formed between the ceiling surface 62*c* of the connection portion 62 and the ceiling surface 60*c* of the outlet flow path 60. An angle of a size of the curve of the corner portion 64 is formed to be an obtuse angle. The corner portion 64 can make it difficult to remove the flushing water flowing along the ceiling surface 60*c* of the outlet flow path 60 from the ceiling surface 62*c* of the connection portion 62.

The corner portion 64 forms a narrow portion (throttle portion) that narrows a flow path in a further upstream side than the outlet flow path 60. The corner portion 64 and connection portion ceiling surface 62*c* narrow a flow path sectional area of the flow path of the jet water conduit 31, and form a minimum flow path sectional area in the jet water conduit 31. Accordingly, a flow velocity of the flushing water is accelerated in the narrow portion. Thereby, the flow velocity of the flushing water which passes through the narrow portion is accelerated to generate a jet flow, so that a Coanda effect that the flow of the flushing water is drawn to the outlet flow path ceiling surface 60*c* and the flushing water flows along the ceiling surface 60*c* is easily generated efficiently.

The narrow portion may be in another shape that can narrow the sectional area of the flow path of the jet water conduit 31. The narrow portion may be disposed in any position in the jet water conduit 31. For example, widths of left and right side walls may be narrowed, or a height from a floor surface to a ceiling surface may be narrowed. Further, the narrow portion may be formed in a shape of a protruded portion protruded from a wall surface, in a mound shape, an arc shape, a semispherical shape or the like. The narrow portion may also have a flow path narrowed by the inlet portion of the outlet flow path 60. Further, the narrow portion may be formed over a fixed length as a result of a shape in which the flow path is narrowed (a shape in which substantially the same flow path sectional area is kept, for example) continuing over a plurality of regional portions of the outlet flow path 60, the connection portion 62 and the like.

The ceiling surface 60*c* of the outlet flow path 60 is formed over a predetermined length in the longitudinal direction. Accordingly, the Coanda effect that the flow of flushing water is drawn to the ceiling surface 60*c* and flows along the ceiling surface 60*c* can be efficiently generated. In addition, the flat portion is formed over the predetermined length, whereby after the Coanda effect is efficiently generated, the flushing water can be spouted from the outlet flow path 60 before the flushing water removes from the ceiling surface 60*c* of the outlet flow path 60.

The ceiling surface 60*c* of the outlet flow path 60 is oriented toward an upper side region A between a top portion 22*e* of the inlet portion 22*a* of the water discharge trap conduit 22 and a center portion 22*f* thereof. More specifically, as illustrated in FIG. 3, in the section along the center, a virtual line L1 along the ceiling surface 60*c* of the outlet flow path 60 reaches the upper side region A in an extended line of the virtual line L1. Therefore, the flushing water flowing along the ceiling surface 60*c* of the outlet flow path 60 by the Coanda effect is jetted in a direction along the ceiling surface 60*c*, and rectilinearly heads toward the upper side region A. The flow can efficiently push flushing water, waste and the like in the lower portion of the bowl section 20 toward a downstream side in the water discharge trap conduit 22 also from the upper side region A of the water discharge trap conduit 22.

Next, with reference to FIGS. 1 to 5, an operation (action) of the flush toilet according to the one embodiment of the present invention will be described. In a numerical analysis result illustrated in FIG. 5, directions of flows of flushing water are shown by arrows, long arrows in dark colors (dark gray and color close to black) in terms of density indicate regions where the flow velocity of flushing water is high and water force is strong, and short arrows in light colors (light gray and color substantially close to white) in terms of density indicate regions where the flow velocity of flushing water is low and water force is weak.

When a user presses an operation button (not illustrated) for washing stool, a signal from the operation button (not illustrated) is transmitted to a controller (not illustrated), and a washing operation for washing stool of the flush toilet 1 is started.

When the user operates the operation button (not illustrated), the controller allows flushing water to pass through the water conduit 28, and the rim water path 24 from the water supply source such as city water, and spouts the flushing water rearward from the rim spout port 26. The flushing water spouted from the rim spout port 26 forms a swirl flow that flows downward while swirling in the bowl section 20 through the water passage 30 to wash an inner wall surface of the bowl section 20.

Thereafter, jet water spout is started. First, the controller transmits a signal to the pressure pump 36 to actuate the pressure pump 36. The flushing water stored in the water storage tank 34 flows into the pressure pump 36 and is pressurized. The flushing water pressurized by the pressure pump 36 passes through the jet water conduit 31 to be spouted from the jet spout port 32 which is opened in the lower portion (bottom portion) of the bowl section 20.

The flushing water flowing down in the jet water conduit 31 has the flow velocity of the flushing water accelerated by the narrow portion formed by the corner portion 64. Since the flow velocity of the flushing water is accelerated in the corner portion 64, the flow velocity of the flushing water passing in the outlet flow path 60 is accelerated to easily generate the Coanda effect that a part of the flow of the flushing water flows along the ceiling surface 60*c* of the outlet flow path 60. In addition, the flow velocity of the flushing water spouted from the jet spout port 32 is accelerated, so that the water discharge trap conduit 22 is filled relatively early to be able to advance the timing for startup of a siphon action that discharges waste. Since the water discharge trap conduit 22 can be filled relatively early, siphon can be efficiently started up with a small amount of flushing water.

Figure 5:
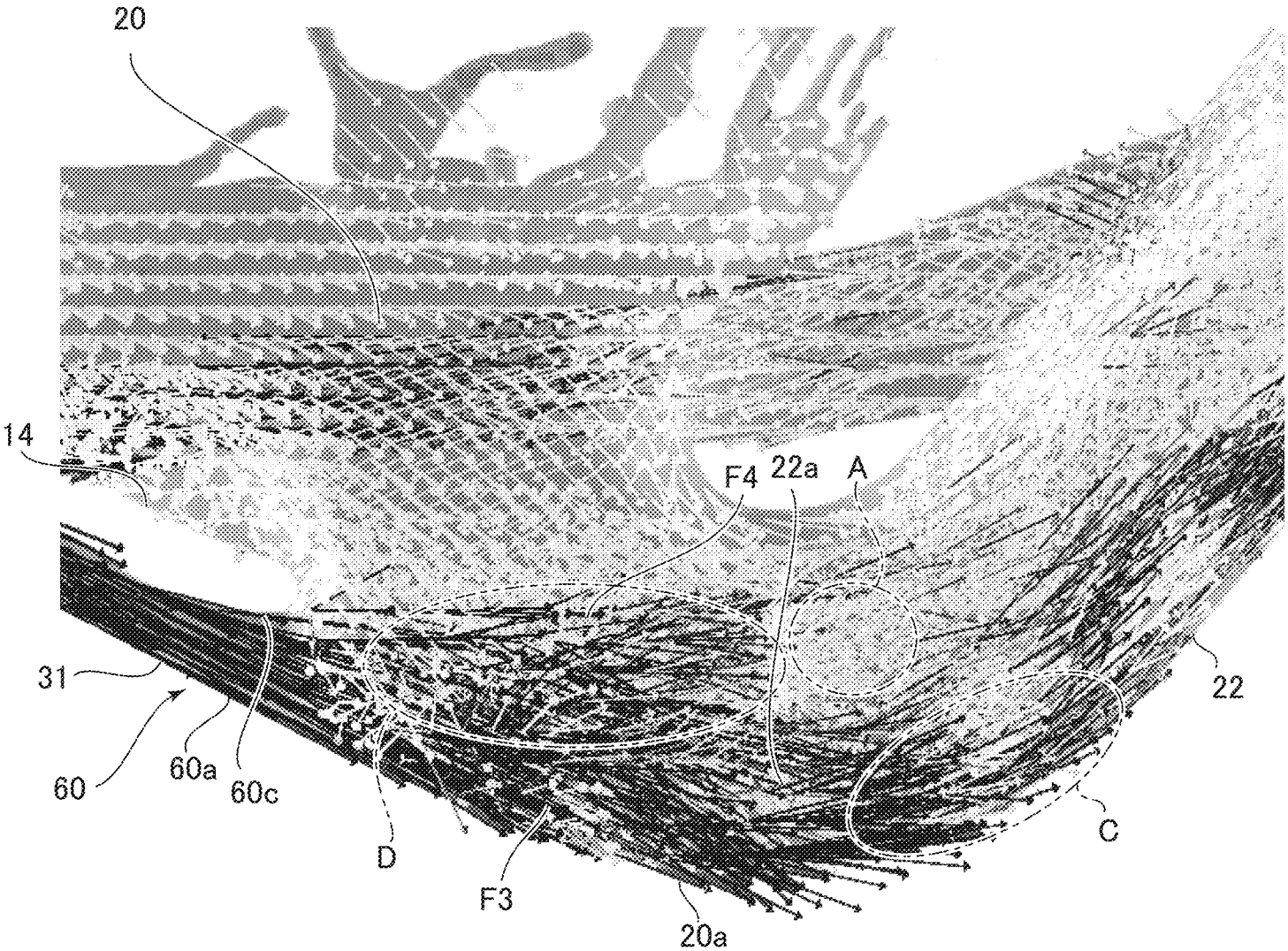
FIG. 5 illustrates one example of a result of analyzing distribution of a flow velocity in a vicinity of an inlet portion of the water discharge trap conduit for flushing water spouted from the jet spout port at the time of performing toilet flushing by using the flush toilet according to the one embodiment of the present invention.

As illustrated in FIGS. 3 and 5, a main flow of the flushing water flowing in the outlet flow path section 60 flows along the outlet bottom surface 60*a* of the outlet flow path 60, and flows out from the outlet 32*a* along the bottom surface 20*a* of the bowl section 20, as shown by an arrow F1 in FIG. 3. Since the outlet bottom surface 60*a* of the outlet flow path 60 and the bottom surface 20*a* of the bowl section 20 are formed to be substantially flush with each other, the flushing water can flow in the bottom surface 20*a* of the bowl section 20 while keeping a water force and a flow velocity along the outlet bottom surface 60*a*.

Accordingly, by filling the water discharge trap conduit 22 relatively early, timing for startup of the siphon action that discharges waste can be advanced. Further, a relatively strong flow that forces waste to flow out from the lower side region B of the inlet portion 22*a* of the water discharge trap conduit 22 is formed. Here, the lower side region B is defined as a region between the center portion 22*f* and the lower portion 22*g* of the inlet portion 22*a*.

As shown by an arrow F3 in FIG. 5, the main flow that flows out along the outlet flow path bottom surface 60*a* flows along the bowl section bottom surface 20*a*, and forms a flow that rises along a lower portion side of the water discharge trap conduit 22 from the lower side region B. In the analysis result illustrated in FIG. 5, in a region C along the lower portion side of the water discharge trap conduit 22, a relatively high flow velocity of the flushing water heading toward the downstream side of the water discharge trap conduit 22 is obtained.

A flow of a part of the flushing water flowing in the outlet flow path 60 generates the Coanda effect as shown by an arrow F2 in FIG. 3, is drawn to the ceiling surface 60*c* of the outlet flow path 60 and flows along the ceiling surface 60*c*.

In FIG. 5, as shown by an arrow F4, the flow that flows out along the ceiling surface 60*c* of the outlet flow path 60 forms a flow heading toward the upper side region A. In a region D on the extended line of the ceiling surface 60*c* of the outlet flow path 60, a relatively high flow velocity of the flushing water is also obtained. Accordingly, in a region in a vicinity of the top portion 22*c* of the water discharge trap conduit 22 and the upper side region A, a relatively high flow velocity of the flushing water heading to the downstream side in the water discharge trap conduit 22 is also obtained.

The flow heading toward the upper side region A can also discharge waste from the upper portion side of the inlet portion 22*a* of the water discharge trap conduit 22 in such a manner as to push the waste to the downstream side. Further, waste can be joined to the main flow with a relatively strong water force that flows in the lower portion side of the water discharge trap conduit 22, and the waste also can be discharge relatively efficiently with the main flow with a relatively strong water force. Furthermore, the flow heading toward the upper side region A can also wash away relatively light floating waste and the like in the upper portion side of the inlet portion 22*a* of the water discharge trap conduit 22 to the downstream side, and can reduce residual waste and the like that tend to remain in the upper side region A in the vicinity of the inlet portion 22*a*.

The flushing water spouted from the jet spout port 32 flows into the water discharge trap conduit 22, and fills the water discharge trap conduit 22 to cause a siphon phenomenon. By the siphon phenomenon, stored water and waste in the bowl section 20 are sucked into the water discharge trap conduit 22 and are discharged from a drain pipe (not illustrated) at the downstream side.

After a lapse of a predetermined time after the flushing water is supplied to the toilet main body 2, the controller (not illustrated) finishes spout of water from the rim spout port 26, and stops operation of the pressure pump 36 to finish a series of washing operation.

Next, an action in the flush toilet 1 according to the one embodiment of the present invention described above will be described.

First, according to the flush toilet 1 according to the one embodiment of the present invention, the outlet flow path 60 of the jet spout port 32 forms the outlet flow path bottom surface 60*a* that extends toward the outlet 32*a* of the jet spout port 32 and extends toward the bowl section bottom surface 20*a* in the lower portion of the bowl section 20. Accordingly, the jet spout water flow at an initial stage of water supply forms the water flow along the rising conduit bottom surface 22*h* of the water discharge trap conduit 22 from the bowl section bottom surface 20*a* in the lower portion of the bowl section 20, and fills the water discharge trap conduit 22 relatively early, and thereby timing for startup of the siphon action that discharges waste can be advanced. In addition, the outlet flow path 60 of the jet spout port 32 forms the outlet flow path ceiling surface 60*c* that extends toward the outlet 32*a* and has an inclination heading toward an upper direction than the inclination of the outlet flow path bottom surface 60*a*. Accordingly, the flow which pushes waste to the downstream side can be also formed in the upper side region A of the water discharge trap conduit 22, by a flow of a part of the jet spout water flow that flows along the outlet flow path ceiling surface 60*c* by the Coanda effect, and waste can be efficiently discharged from the water discharge trap conduit 22. Consequently, according to the flush toilet 1 according to the present embodiment, discharge performance of waste from the water discharge trap conduit 22 can be enhanced.

Next, according to the flush toilet 1 according to the present embodiment, the jet spout water flow at the initial stage of water supply can be formed as a smooth water flow along the bowl section bottom surface 20*a* in the lower portion of the bowl section 20 from the outlet flow path bottom surface 60*a* of the outlet flow path 60 in the jet spout port 32. Consequently, according to the flush toilet 1 according to the present embodiment, the water flow along the bottom surface of the water discharge trap conduit 22 from the bowl section bottom surface 20*a* is formed earlier, and the water discharge trap conduit 22 is filled relatively early, whereby the timing for startup of the siphon action that discharges waste can be more advanced.

Further, according to the flush toilet 1 according to the present embodiment, the outlet flow path ceiling surface 60*c* of the outlet flow path 60 in the jet spout port 32 extends toward the outlet 32*a* substantially horizontally. Consequently, according to the flush toilet 1 according to the present embodiment, the flow of a part of the jet spout water flow that flows along the outlet flow path ceiling surface 60*c* by the Coanda effect can form the flow that pushes waste in the horizontal direction toward the downstream side in the upper side region A of the water discharge trap conduit 22, and waste can be discharged from the water discharge trap conduit 22 more efficiently.

Furthermore, according to the flush toilet 1 according to the present embodiment, the jet spout port 32 includes the corner portion 65 that narrows the flow path sectional area of the flow path at a further upstream side than the outlet flow path 60 of the jet spout port 32, so that the flow velocity of the flow of the jet spout water that is spouted from the jet spout port 32 can be increased. Therefore, the flow velocity of the flow of the jet spout water spouted from the jet spout port 32 at the initial stage of water supply is increased, the water discharge trap conduit 22 is filled relatively early, and timing for startup of the siphon action that discharges waste can be more advanced.

Further, the flow velocity of the flow of a part of the jet spout water flow that flows along the outlet flow path ceiling surface 60*c* is increased by the Coanda effect, and a stronger flow that pushes waste to the downstream side can be formed in the upper side region A of the water discharge trap conduit 22, and the waste can be efficiently discharged from the water discharge trap conduit 22. Consequently, according to the flush toilet 1 according to the present embodiment, the discharge performance of waste from the inside of the water discharge trap conduit 22 can be more enhanced.

Furthermore, according to the flush toilet 1 according to the present embodiment, the outlet flow path ceiling surface 60*c* is formed to be oriented toward the upper side region A between the inlet top portion 22*e* of the inlet portion 22*a* of the water discharge trap conduit 22 and the center portion 22*f* thereof. Consequently, according to the flush toilet 1 according to the present embodiment, the flow of a part of the jet spout water flow that flows along the outlet flow path ceiling surface 60*c* by the Coanda effect can form the flow that pushes the waste to the downstream side can be formed in the upper side region A of the water discharge trap conduit 22, and waste can be efficiently discharged from the water discharge trap conduit 22.

Next, a modified example of the corner portion 64 of the jet spout port 32 of the flush toilet 1 according to the one embodiment of the present invention will be described with reference to FIG. 6.

In the modified example of the corner portion 64 of the flush toilet 1 according to the one embodiment of the present invention, components similar to the components in the flush toilet 1 according to the one embodiment of the present invention described above are adopted, so that the similar components are assigned with the same reference signs and explanation of the components is omitted.

Figure 6:
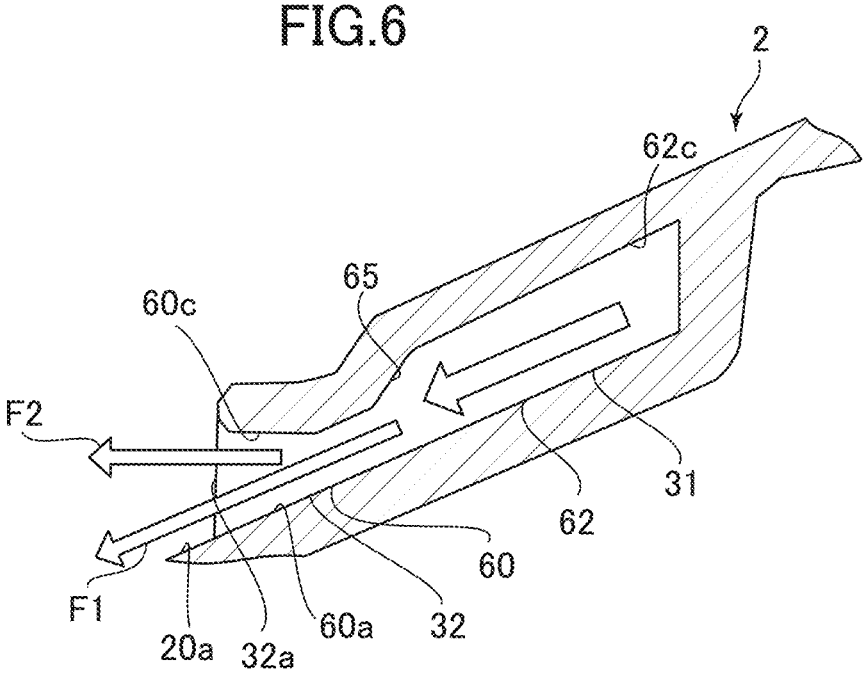
FIG. 6 is a partial enlarged sectional view of the jet spout port illustrating an modified example of a corner portion of the jet spout port in the jet water conduit of the flush toilet according to the one embodiment of the present invention.
Figure 7:
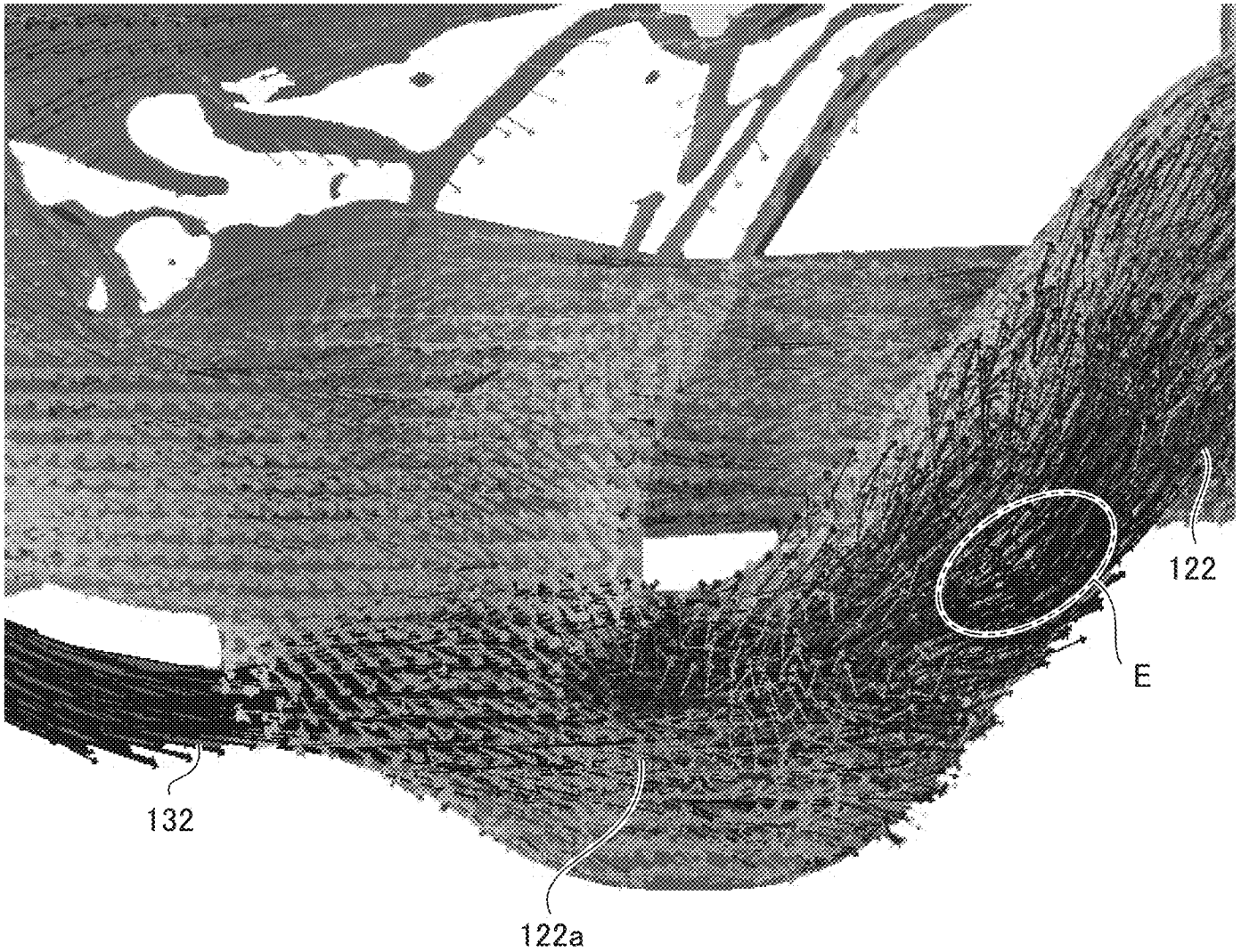
FIG.7 (Prior Art)
FIG. 7 is an analytic diagram illustrating a result of analyzing distribution of a flow velocity in the vicinity of an inlet portion in a water discharge trap conduit for flushing water spouted from a jet spout port extending rectilinearly toward a center of the inlet portion of the water discharge trap conduit when toilet flushing is performed in a conventional flush toilet, as a comparative example of the analysis result illustrated in FIG. 5.
Figure 8:
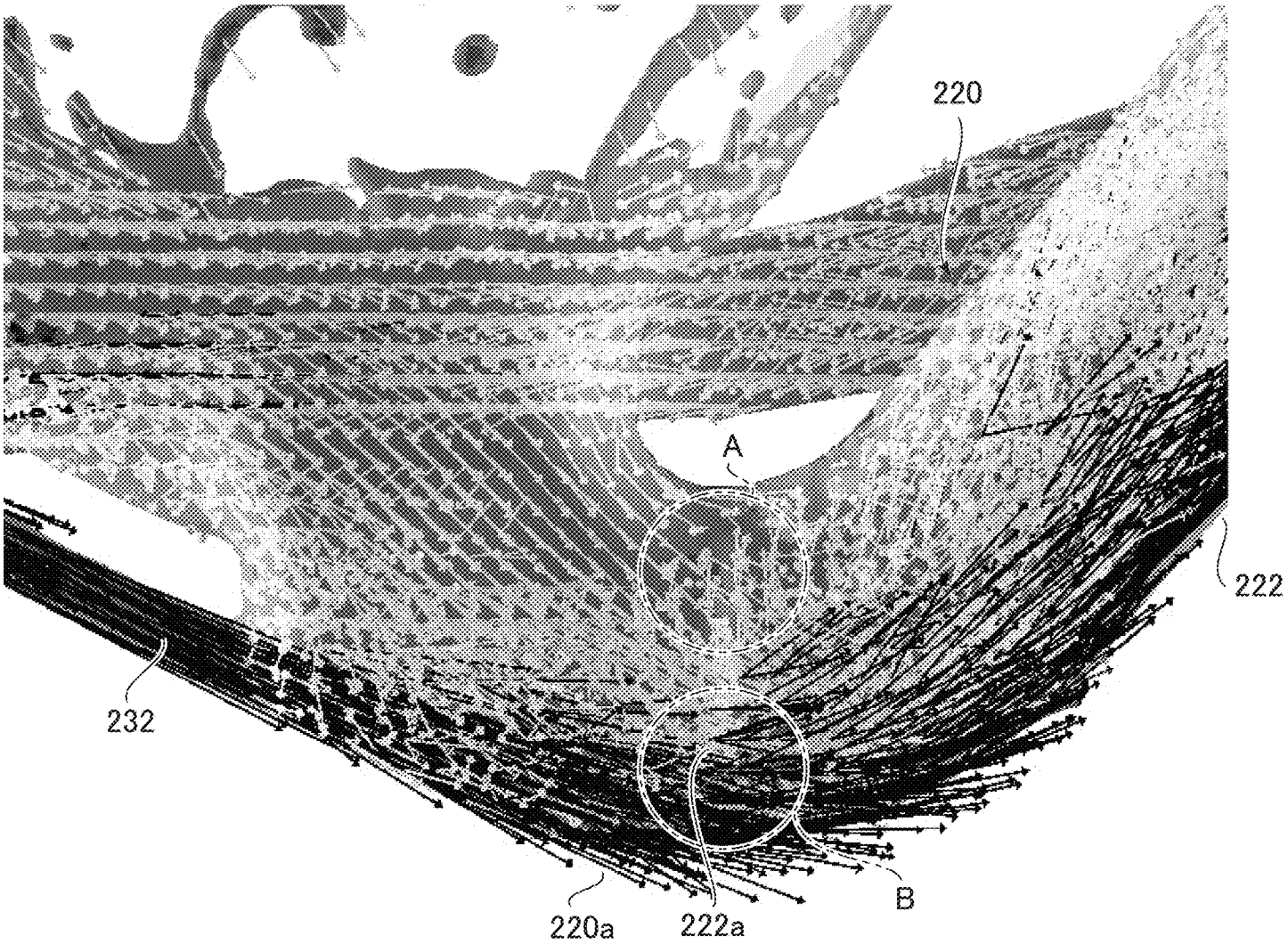
FIG.8 (Prior Art)
FIG. 8 is an analytic diagram illustrating a result of analyzing distribution of a flow velocity in the vicinity of an inlet portion in a water discharge trap conduit for flushing water spouted from a jet spout port extending rectilinearly in parallel with a bottom surface of a bowl section, when toilet flushing is performed in a conventional flush toilet, as a comparative example of the analysis result illustrated in FIG. 5.

In FIG. 6, in the modified example of the flush toilet 1 according to the one embodiment of the present invention, a corner portion 65 of the jet spout port 32 is formed to protrude in the flow path, and has a structure different from the structure of the corner portion 64 of the jet spout port 32 of the flush toilet 1 according to the one embodiment of the present invention.

In the jet spout port 32, the corner portion 65 forming a mild curve is formed between the ceiling surface 62*c* of the connection portion 62, and the ceiling surface 60*c* of the outlet flow path 60. The corner portion 65 is formed to protrude to inside of the flow path from the ceiling surface 62*c* of the connection portion 62. The corner portion 65 forms a narrow portion that narrows the flow path in a further upstream side than the outlet flow path 60.

The corner portion 65 narrows the sectional area of the flow path of the jet water conduit 31, and forms a minimum flow path sectional area in the jet water conduit 31. Accordingly, the flow velocity of the flushing water is accelerated in the narrow portion. Thereby, the Coanda effect that the flow of flushing water is drawn to the ceiling surface 60*c* of the outlet flow path 60 and flows along the ceiling surface 60*c* as shown by an arrow F2 is efficiently generated easily. Thereby, a flow of a part of the flushing water flowing in the outlet flow path 60 flows out in the direction of the ceiling surface 60*c* along the ceiling surface 60*c*. A main flow of the flushing water flowing in the outlet flow path 60 flows along the outlet bottom surface 60*a*, and flows out along the bottom surface 20*a* of the bowl section 20 from the outlet 32*a*, as shown by an arrow F1.

As shown by the arrow F1, the main flow that flows out along the outlet bottom surface 60*a* of the outlet flow path 60 flows along the bottom surface 20*a* of the bowl section 20, and forms a flow that rises along the lower portion side of the water discharge trap conduit 22, from the lower side region B in the lower side of the inlet portion 22*a* of the water discharge trap conduit 22.

As shown by the arrow F2, the flow that flows out along the ceiling surface 60*c* of the outlet flow path 60 forms a flow heading toward the upper side region A. The flow heading toward the upper side region A can discharge waste in such a manner as to push the waste to the downstream side also from the upper portion side of the inlet portion 22*a* of the water discharge trap conduit 22. Further, waste can be joined to the main flow with a relatively strong water force flowing in the lower portion side of the water discharge trap conduit 22, and the waste also can be discharged relatively efficiently with the main flow with the relatively strong water force. Furthermore, the flow heading to the upper side region A also can wash away relatively light floating waste and the like in the upper portion side of the inlet portion 22*a* of the water discharge trap conduit 22 to the downstream side, and remaining waste and the like that tend to remain in the upper side region A in the vicinity of the inlet portion 22*a* can be reduced.

What is claimed is:

1. A flush toilet of a siphon type that is washed by flushing water supplied from a flushing water source, comprising:

a bowl section including a bowl-shaped waste receiving surface, and a rim section formed on an upper edge of the waste receiving surface;

a water discharge trap conduit that is connected to a lower portion of the bowl section to discharge waste; and a jet spout port that spouts water toward an inlet of the water discharge trap conduit, wherein the water discharge trap conduit includes a rising conduit extending diagonally upward from the inlet, wherein the jet spout port includes an outlet flow path having an outlet bottom surface extending downwardly toward an outlet of the jet spout port and toward a bowl section bottom surface in the lower portion of the bowl section, and a ceiling surface extending toward the outlet of the jet spout port, and wherein the ceiling surface of the jet spout port has an inclination which is smaller than a downward inclination of the outlet bottom surface and a virtual line along the ceiling surface at the outlet of the jet spout port extends between a lowest point at a top at the inlet of the rising conduit of the water discharge trap conduit and a center of the inlet.

2. The flush toilet according to claim 1, wherein the outlet bottom surface of the outlet flow path of the jet spout port is connected to the bowl section bottom surface in the lower portion of the bowl section to be substantially flush with the bowl section bottom surface.

3. The flush toilet according to claim 1, wherein the ceiling surface of the outlet flow path of the jet spout port extends substantially horizontally.

4. The flush toilet according to claim 1, wherein the jet spout port further comprises a narrow portion that narrows a flow path in a further upstream side than the outlet flow path of the jet spout port.

5. The flush toilet according to claim 1, wherein the ceiling surface of the outlet flow path of the jet spout port is formed to be oriented toward an upper side region between a top portion of an inlet of the water discharge trap conduit and a center portion of the inlet of the water discharge trap conduit.

* * * * *